United States Patent [19]

Yeh et al.

[11] Patent Number: 4,669,898

[45] Date of Patent: Jun. 2, 1987

[54] DOT MATRIX PRINT HEAD

[75] Inventors: Der-Zong Yeh, Hsin-Chu; Der-Chyen Wang, Hou-Li; Tung-Tian Hsu, Da-Cheng, all of China

[73] Assignees: Electronics Research and Service Organization; Industrial Technology Research Institute, both of Hsin-Chu, Taiwan

[21] Appl. No.: 812,310

[22] Filed: Dec. 23, 1985

[51] Int. Cl.[4] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,690,431 | 9/1972 | Howard | 400/124 |
| 3,994,381 | 11/1976 | Hebert | 400/124 |
| 4,004,673 | 1/1977 | Burzlaff | 400/124 |
| 4,225,250 | 9/1980 | Wagner | 400/124 |
| 4,389,128 | 6/1983 | Asano | 400/124 |
| 4,447,166 | 5/1984 | Ochiai | 400/124 |
| 4,449,836 | 5/1984 | Yamada | 400/124 |
| 4,511,269 | 4/1985 | Takahashi | 400/124 |

FOREIGN PATENT DOCUMENTS

| | | | |
|---|---|---|---|
| 2728093 | 1/1978 | Fed. Rep. of Germany | 400/124 |

*Primary Examiner*—Paul T. Sewell

*Attorney, Agent, or Firm*—Cahill, Sutton & Thomas

[57] ABSTRACT

A print head for a dot matrix printer in which the printing ends of the print wires are disposed in two parallel rows. A plurality of electromagnetically actuated armatures have their moveable ends connected to the driven ends of the print wires. All of the armatures are of substantially the same length and are disposed radially in an elliptic array so as to minimize the curvatures of all of the print wires. Regions of the print wires intermediate their ends are guided by several guide members housed in a nose member of the head. At least some of the guide members have a pair of arcuate slots therein each adapted to guide approximately one half of the total number of the wires. The nose member is attached to a covered portion of the head by threaded fasteners and a resilient spacer between the nose member and the cover permits the position of the nose member in relation to the printing ends of the print wires to be adjusted by manipulating the threaded fasteners.

2 Claims, 7 Drawing Figures

DOT MATRIX PRINT HEAD

TECHNICAL FIELD

This invention relates to the field of high speed printing and, more particularly, to the print head of a dot matrix printer.

BACKGROUND ART

The ever-increasing quantity of printed information being created, particularly by modern computer systems, has made it necessary to devise typewriting machines which operate at extraordinarily high speeds. One of the most successful types of such machines is a dot matrix printer in which a printing head contains a plurality of electromagnetically actuated wires capable of printing a matrix of dots with their ends to form visually perceivable characters. A significant advantage of of this type of machine is that a single printing head can be used to print an endless variety of letters and characters in a number of languages, such as, for example, English and Chinese.

U.S. Pat. No. 4,389,128 granted June 21, 1983 to K. Asano, et al., for "Print Head For A Dot Matrix Printer" discloses what can be termed a state-of-the-art print head of the type with which the present invention is concerned. The Asano et al. print head has a plurality of radially arranged wire actuating armatures which are maintained in a non-print position by a magnetic structure including an annular permanent magnet. The individual armatures are spring biased to move to their print positions when individual electromagnets associated with the armatures are energized to cancel out the flux from the permanent magnet. The armatures are radially disposed in a circular array and have print wires affixed to their moveable inner ends. The moveable ends of the armatures are disposed in a circle. The other, or printing, ends of the printing wires are positioned in a closely packed array, usually consisting of one or two upright rows.

There is considerable demand for dot matrix printer heads capable of printing high quality characters, i.e., characters which are so formed that the human eye cannot detect the fact that they have been formed from a plurality of individual dots. To achieve this quality of printing, the print head may be equipped with as many as twenty-four print wires. This means that the print head must also contain an equal number of armatures and electromagnets. In order to hold down the size and weight of the print head—which must be done to reduce the inertia of the head,—the wires, the armatures and the electromagnets are all made quite small and are closely compacted within the print head. There is a physical limitation, however, as to how close together the moveable ends of the armatures can be placed because of the bulk of the armatures themselves. Consequently, in prior art print heads, such as that disclosed in the Asano et al. patent, the moveable ends of the armatures and the driven ends of the print wires associated therewith are disposed in a circle which is considerably larger in diameter than some of the dimensions of the array in which the other, or printing, ends of the wires are disposed. This means that the print wires must possess a curvature from their ends to their printing ends and this curvature usually varies from wire to wire.

Dissimilarities between different ones of the wire-armature assemblies within the print head are undesirable because this can cause different printing wires to behave differently from other printing wires in the head during operation of the head. When one considers that the slender print wires must move from a rest position to an impact position and return to the rest position within a time interval of one millisecond or less while providing an impact of sufficient force to print a clearly legible dot without any bounce either on the printing surface or at the rest position, it can readily be appreciated that substantial variations in length and curvature of the individual print wires or in the length or configuration of their armatures can cause the head to print some dots differently from other dots. This "erratic" performance can be expected of some print heads constructed as taught in the Asano et al. patent.

Similar behavior is to be expected of print heads constructed as taught in U.S. Pat. No. 4,225,250, granted Sept. 30, 1980 to R. E. Wagner et al. for "Segmented-Ring Magnet Print Head." In an attempt to bring the position of the driven ends of the print wires into closer correspondence with the positions of the printing ends of these wires, Wagner et al. associate different wires with armatures of different lengths. It should be obvious that an armature which is of different size and mass than its neighbor is likely to have different performance characteristics as well.

A somewhat different print head construction is disclosed in U.S. Pat. No. 3,690,431, granted Sept. 12, 1972 to R. Howard for "Print Head Assembly Containing Solenoids." In the construction disclosed in that patent, various guide members are provided for the print wires to control the behavior of the wires during operation, but because of the relative disposition of the driven ends of the wires in relation to the printing ends of the wires, different wires have different lengths and different curvatures and, therefore, different operating characteristics.

There continues to be a need, therefore, to improve the operating and performance characteristics of high speed print heads.

DISCLOSURE OF THE INVENTION

This invention contemplates the construction of a dot matrix print head which minimizes differences between the several print wire-armature assemblies. The invention further contemplates a print head construction which minimizes the degree of curvature which the print wires are required to experience. To accomplish these objectives, the moveable ends of the armatures are disposed in an elliptic array, the major axis of which is generally parallel to the two rows in which the printing ends of the print wires are disposed. In addition, the spring supports for the other ends of each of the armatures are also disposed in an elliptic array so that the effective length of each armature and its spring mounting are exactly the same from one armature to the next. To further assure identical operating characteristics for all of the armature-print wire assemblies, the fixed portions of the springs supporting the armatures are clamped adjacent an annular fulcrum ring which has a serrated inner edge presenting a generally straight segment normal, i.e., at right angles, to each of the armatures at exactly the same distance from the moveable end of each such armature. This assures that the dynamic operating characteristics of each of the armatures and their associated print wires will be the same.

Like some prior print heads, the print head of this invention employs means for guiding the print wires intermediate their ends. In accordance with the invention, a plurality of guides are located within a nose portion of the print head to cause the wires to retain their natural curvature. At least one guide nearest the driven ends of the wires has a pair of arcuate slots therein, each of which is adapted to guide approximately one half of the total number of wires employed in the head. A second guide disposed somewhat farther away from the driven ends of the wires may also contain two arcuate slots, but these slots will have less curvature and be closer together than the slots in the first mentioned guide. The next guide may have nearly straight slots therein. And the final guide, which is positioned within the outermost nose portion of the head, preferably is a drilled jewel piece having individual holes for positioning the printing ends of the print wires in the two-row array desired.

Wear of the printing ends of the print wires resulting in slight shortening of the wires is a condition frequently encountered with high speed dot matrix print heads. The worn wires, when in a print, or impact, position will not protrude as far from the nose of the print head as did the original unworn wires. In accordance with this invention, there is provided an adjustable mounting arrangement for the printer nose portion so that the nose guide, i.e., the final guide at the tip of the nose, can be moved relative the wires to compensate for wire wear. This mount preferably takes the form of a yieldable spacer between the nose portion and a cover portion of the print head in combination with a threaded fastener connecting the nose portion and the cover. The threaded fastener can be manipulated to move the nose portion closer to the cover of the print head to reposition the printing ends of the print wires in relation to the nose guide.

BRIEF DESCRIPTION OF THE DRAWINGS

The invention is described in greater detail hereinafter by reference to the accompanying drawings wherein.

BEST MODE FOR CARRYING OUT THE INVENTION

Figure 1:
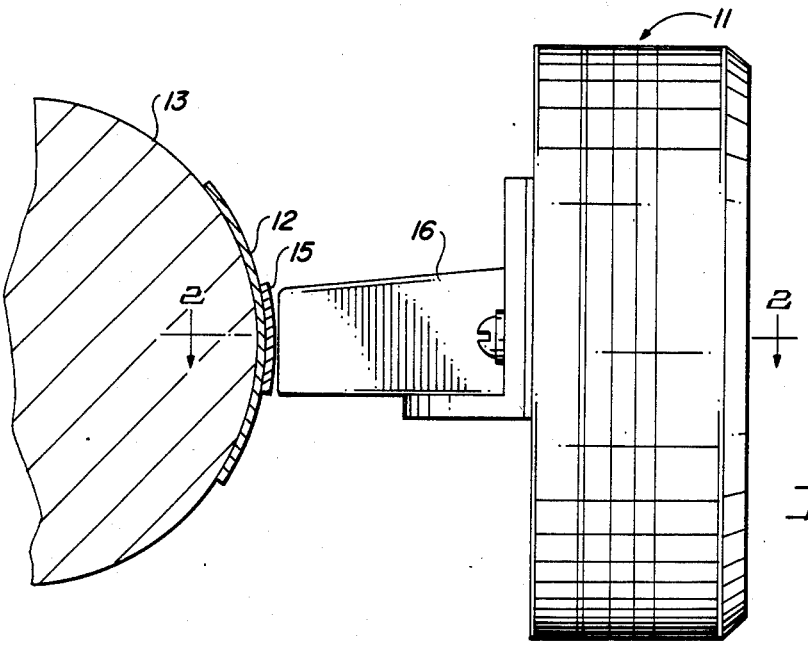
FIG. 1 is an elevational view of a portion of a typewriter utilizing the print head of this invention.
Figure 2:
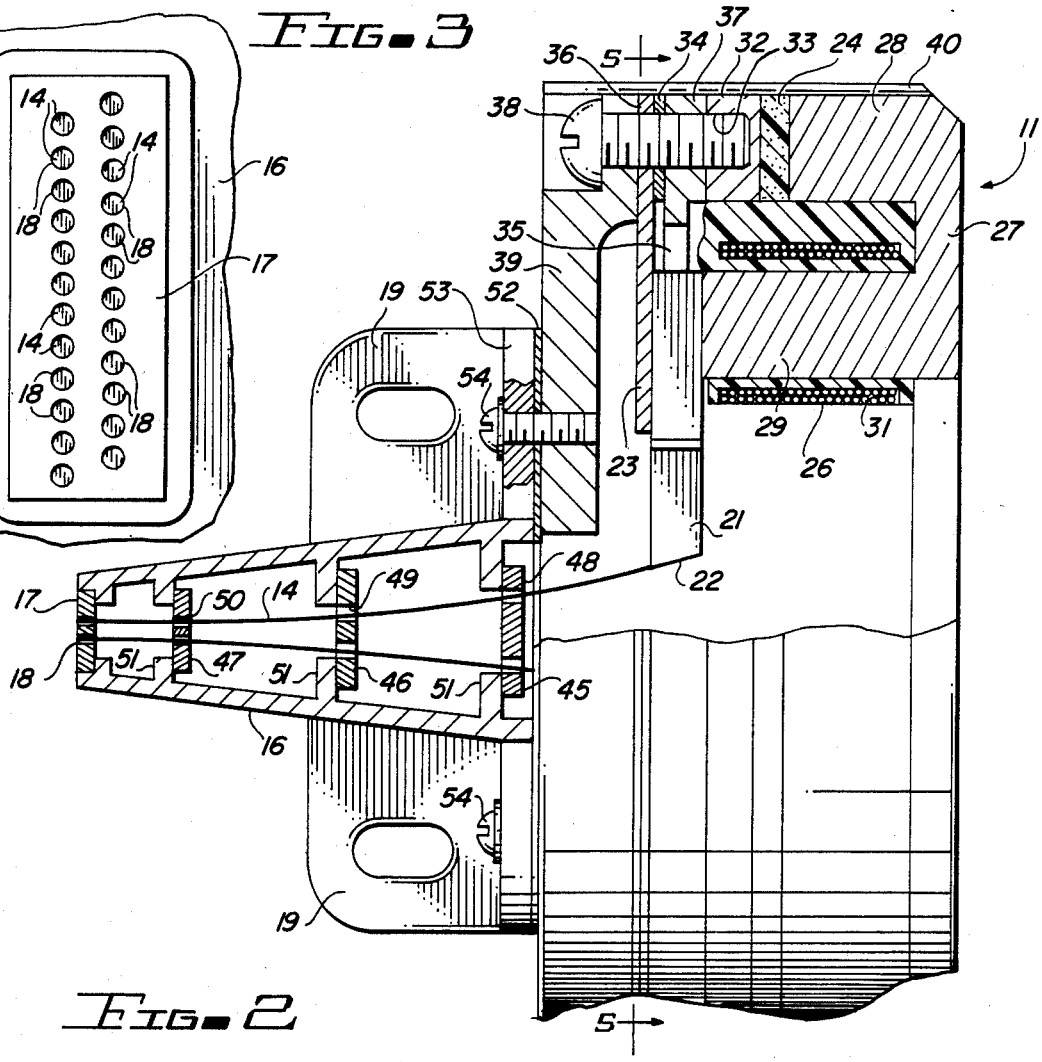
FIG. 2 is a plan view, partially in section of the print head of FIG. 1.

Referring particularly to FIGS. 1 and 2, the print head embodying this invention is designated generally by reference numeral 11 and is adapted to produce characters on the surface of a sheet of paper 12 positioned on a platen 13. The characters are composed of a matrix of dots produced by a plurality of print wires 14 impacting on an inked ribbon 15. The print wires 14 are guided to the ribbon 15 by a nose portion 16 of the print head 11.

Figure 3:
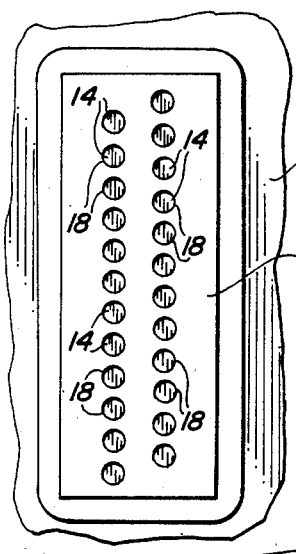
FIG. 3 is an enlarged, fragmentary, elevational view of a nose portion of the print head.

In the preferred mode for carrying out this invention, the printing ends of print wires 14, i.e., the ends which are adapted to contact inked ribbon 15 to produce dots on paper 12, are preferably positioned in an array consisting of two vertical rows by a nose guide 17 carried at the forward end of nose portion 16. (See FIGS. 2 and 3). Nose guide 17 is preferably formed of ruby jewel or other hard, non-wearing material and has a plurality of holes 18 formed therein to correctly position and guide the printing ends of print wires 14. In the interest of producing high quality characters, i.e., characters which the human eye cannot perceive to have been formed of a plurality of dots, the two vertical rows of print wires 14 at their printing ends are preferably offset, or staggered, with respect to each other in such a manner that there can be an overlapping of dots produced by the wires of one row with respect to the dots produced by the wires of another row. As shown in FIG. 3, each row of print wires 14 in guide 17 contains the same number of wires, say, twelve for a twenty-four wire print head. It has been demonstrated previously that a twenty-four wire dot matrix print head is capable of producing high quality characters.

It is to be understood, of course, that the print head 11 and platen 13 are mounted on a suitable carriage (not shown) which permits rotation of the platen and translation of the print head from side to side across the platen. If desired, the nose portion 16 of print head 11 can be provided with mounting flanges 19 for fastening the print head to the carriage.

The print wires 14 of the print head 11 are manipulated to contact ribbon 15 and produce dots on paper 12 under control of electromagnetic means housed in the body of the print head 11. The mechanism for actually manipulating print wires 14 comprises a plurality of armatures 21 connected to driven ends 22 of wires 14 and supported within the print head 11 by spring members 23 which bias the armatures 21 toward a print, or impact, position in which the printing ends of the wires 14 contact ribbon 15. Armatures 21 are drawn to a nonprint, or cocked, position against the bias of spring members 23 by magnetic forces produced by a permanent magnet 24. The effect of permanent magnet 24 on individual armatures 21 is selectively cancelled by means of a plurality of electromagnets 26 to allow a spring member 23 to propel its armature 21 and the print wire 14 attached thereto to the print, or impact, position. This overall arrangement for manipulating print wires 14 is sometimes referred to as the "spring stored energy system" and is used extensively in modern day dot matrix print heads. The present invention provides certain refinements to this system which enables the print head to function at higher speeds and with a greater degree of reliability and print quality.

The magnetic circuit for print head 11 comprises a circular core base 27 having an annular yoke member 28 projecting from the forward face thereof and a plurality of electromagnet cores 29 disposed on the core base 27 inside the yoke member 28. The electromagnet cores 29 have electrical windings 31 thereon. Cores 29 with electrical windings 31 constitute the electromagnets 26 referred to previously. Permanent magnet 24 is formed as an annular ring of any of the wellknown permanent magnetic material, such as the rare earth metals, and is cemented or otherwise affixed to the annular face of yoke member 28. The opposite face of permanent magnet 24 has adhered thereto, as by cementing, an annular yoke ring extension 32 having a plurality of threaded recessee 33 for securing the remaining components of the print head to the core base 27.

Figure 4:
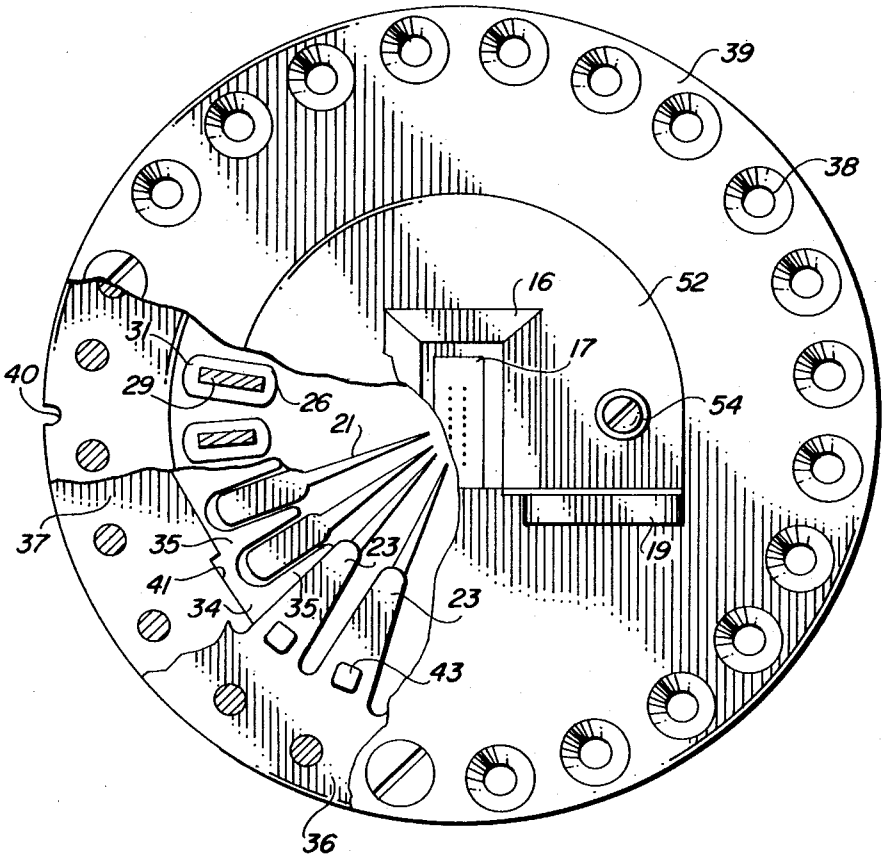
FIG. 4 is a front elevational view of the print head with portions broken away to show the internal components.

Further components of the magnetic circuit in the print head 11 include a yoke plate 34 having a plurality of fingers projecting radially inwardly between armatures 21 (see FIGS. 2 and 4). Armatures 21 are moveably positioned between fingers 35 of yoke plate 34 by means of an annular spring plate 36, inwardly extending fingers of which constitute spring members 23 which are welded, or otherwise affixed to the armatures 21. A fulcrum ring 37, which, like the annular spring plate 36 is preferably formed of magnetically permeable material, is disposed between the spring plate and yoke plate 34. These elements are clamped in face to face relationship by means of a plurality of screws 38 which plass through matching openings in these members and in an annular cover member 39 and are received in the threaded recesses 33 of annular yoke ring extension 32. If desired, an alignment slot 40 can be provided in the outer edge of each of the components which make up the body of the print head 11 to assure proper alignment of the various components when they are assembled.

Operation of the components of the magnetic circuit just described is as follows. The permenant magnet 24 establishes a flux which permeates yoke member 28, core base 27 and electromagnetic cores 29. This same flux also permeates yoke ring extension 32, yoke plate 34 and armatures 21. Some flux may also pass through fulcrum ring 37 and spring plate 36 to the armatures 21. The effect of the application of this flux from permanent magnet 24 is that the armatures are caused to move toward and close the gap between them and their respective electromagnetic cores 29 and against the bias of spring members 23 which tend to hold the armatures 21 out of contact with their cores 29. With all the armatures 21 held against their cores 29 by the flux from permanent magnet 24, the print wires 14 attached to these armatures are drawn to a non-print, or cocked position with their printing ends flush with or just inside the outer face of nose guide 17. When it is desired to manipulate one of the print wires 14 to cause its printing end to move outwardly of the nose guide 17 to contact inked ribbon 15, the electromagnet 26 for the armature attached to the selected wire is energized by passing electric current through its winding 31. The winding on each electromagnetic core 29 is such that when energized it induces a magnetic flux within that core which is in opposition to the flux therein generated by the permanent magnet 24. This has the effect of releasing the selected armature 21 from that field so that its respective spring member 23 can swing the armature 21 forward away from the electromagnetic core 29. The moveable end of the armature, to which is attached the driven end 22 of its print wire 14, propels the wire forward so that its printing end is driven into contact with the ribbon 15. Electric current is supplied to windings 31 in very short pulses so that the armatures 21 which are released to cause print wires 14 to move are very shortly thereafter recaptured by the flux from the permanent magnet and returned to their non-print positions in contact with cores 29. For a high speed dot matrix printer, these movements of the components within the system occur incredibly quickly and must be performed with absolute precision to ensure the creation of the desired legible characters on the paper 12.

To ensure reliable performance of the armature 21-print wire 14 assemblies within the print head, the print head components are constructed and arranged in such a manner as to minimize differences in operating characteristics between the several armature 21-print wire 14 assemblies. Specifically, these assemblies are constructed and arranged in such a manner that: (a) all of the print wires are required to undergo a minimum of curvature from their driven to their printing ends; (b) the actual curvature of each print wire 14 is close to the curvature of every other print wire 14 in the print head; (c) the length of each print wire 14 is close to the length of every other print wire in the print head; (d) each armature 21 is virtually identical in size, shape and mass to every other armature in the print head; and (e) the flexible spring mounting for each armature 21 is virtually identical to the spring mounting of every other armature in the print head. With these characteristics imparted to the components of the print head 11, one can expect the dynamic behavior of each armature 21-print wire 14 assembly to be substantially the same as that of its neighbors in the print head so that each dot in the matrix producing characters will be the same as every other dot printed by the head.

Figure 5:
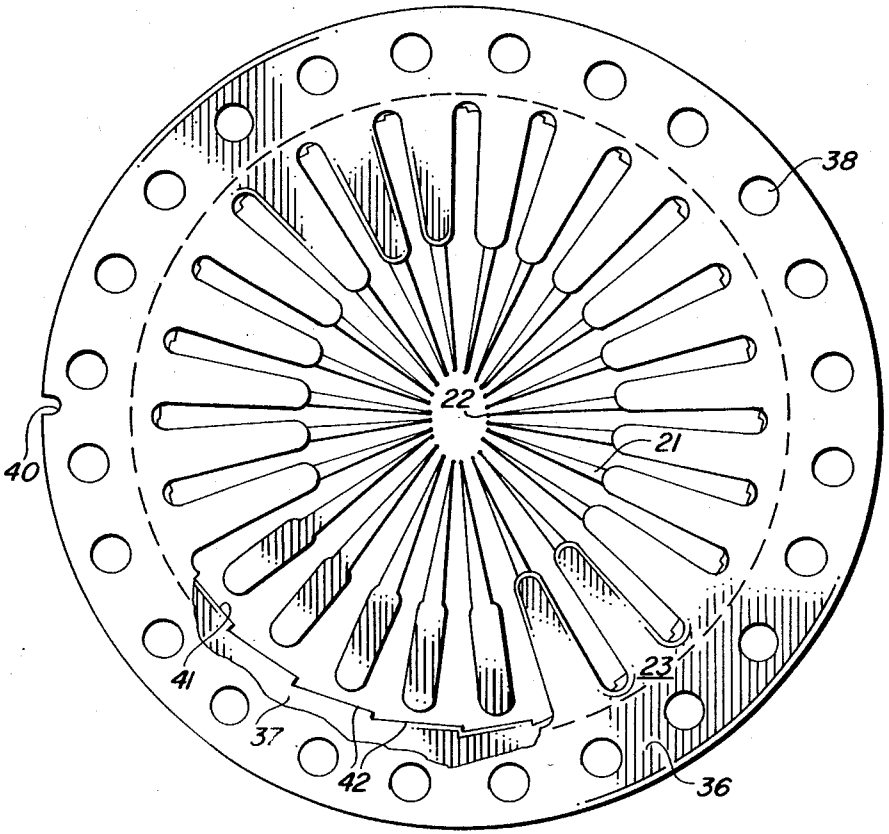
FIG. 5 is a vertical sectional view through the print head taken generally as indicated by the line 5—5 in FIG. 2.

It must be recognized, of course, that in virtually all high speed dot matrix print heads, the print wires 14 must undergo some degree of curvature between their driven ends and their printing ends. This is due to the usual requirement that there be a different array configuration of the printing ends of the wires than of the driven ends of the wires. It is desireable that the printing ends of the wires be arrayed quite closely together and in near vertical rows as illustrated in FIG. 3. Utilizing wires having a diameter of approximately 0.2 to 0.3 millimeters, with the spacing between the wires in each row being approximately 0.284 to 0.5 millimeters, a twenty-four wire array can be constructed in a relatively small space. The situation is different at the other end of the wires, however. The driven ends of the wires are attached to armatures 21 which must have sufficient bulk to have the strength and rigidity to perform their required functions. Consequently, the moveable ends of the armatures 21 which are attached to the print wires 14 cannot be brought into a closely compacted array like that of the printing ends of the wires. The moveable ends of the armatures 21 must be given some amount of spacing and this means that the driven ends of the wires are going to be farther apart than the printing ends of the wires. So the print wires must undergo some curvature. Moreover, as suggested previously, for reasons of life expectancy of the print wires 14 and for uniformity of performance, it is desirable that the print wires undergo a minimum amount of curvature and that the curvature of each print wire be closely similar to the curvature of every other print wire. An important feature of this invention allows these objectives to be realized. According to this invention, the moveable ends of the armatures 21 and the driven ends of wires 14 attached thereto are disposed in an elliptic pattern (see FIG. 5) when the printing ends of the wires are to be disposed in parallel rows. Specifically, the wires 14 are arranged so that the driven ends thereof are disposed in an elliptic array the major axis of which is essentially parallel to the rows of wire ends at the printing ends of the wires. Proper positioning of the driven ends of the wires 14 in their elliptic array can result in each wire undergoing a minimum amount of curvature.

Now, in order to achieve the same performance characteristics from each wire 14-armature 21 assembly, it is desirable that this elliptic disposition be carried over into the disposition of the armatures 21, the disposition of the magnetic elements associated with the armatures, such as the yoke plate fingers 35 and the electromagnetic cores 29, and the spring members 23 supporting the armatures. If the elliptic disposition of the driven ends 22 of printed wires 14 is achieved by shortening lenghtening certain of the armatures 21, the desired reor will not be achieved because this would result in the arsults matures having different masses and therefore different behavioral characteristics. On the contrary, in accordance with this invention, all the armatures 21 are constructed identically and disposed generally radially in an elliptic array corresponding to the elliptic array desired for the driven ends of wires 14. The cores 29 of the electromagnetics 26 are also preferably disposed in a corresponding elliptic array and the fingers 35 on the yoke plates 34 which interdigitate between the armatures are also arranged in corresponding elliptic array. Lastly, the spring members 23 on spring plate 36 are also disposed in a comparable elliptic array and fulcrum ring 37 is constructed to provide a fulcrum for each spring member 23 which is at the same distance from the moveable end of armature 21 for each armature. To accomplish the latter, the fulcrum ring 37 preferably has a serrated, or sawtooth-like, inner edge 41 which provides a plurality of straight line segments 42 normal to the longitudinal axes of the armatures. (See FIG. 5). The segments 42 on the inner edge 41 of fulcrum ring 37 are also disposed in an elliptic array generally comparable to the elliptic array for the driven ends 22 of print wires 14. By this arrangement, the spring mounting for each armature and its moment of inertia is exactly the same as every other armature. If desired, the annular spring plate 36 can be provided with a plurality of openings 43 at the base of each spring member 23 in the vicinity of fulcrum segments 42 to improve the motion stability of the spring members. (The openings 43 have been omitted from FIG. 5 to simplify the illustration.)

Another feature of this invention resides in the manner of guiding the print wires 14 through the nose portion 16 of the print head 11. In most high speed dot matrix print heads, because of the fineness of the print wires 14, it is desirable to guide the wires through their curvature to reduce the tendency for the wires to buckle when they are driven to their print positions. In certain prior art print heads, it has been the practice to provide individual guide channels for each of the print wires passing through the nose of the head. This has resulted in costs of production which are deemed to be unnecessarily high.

Figure 6:
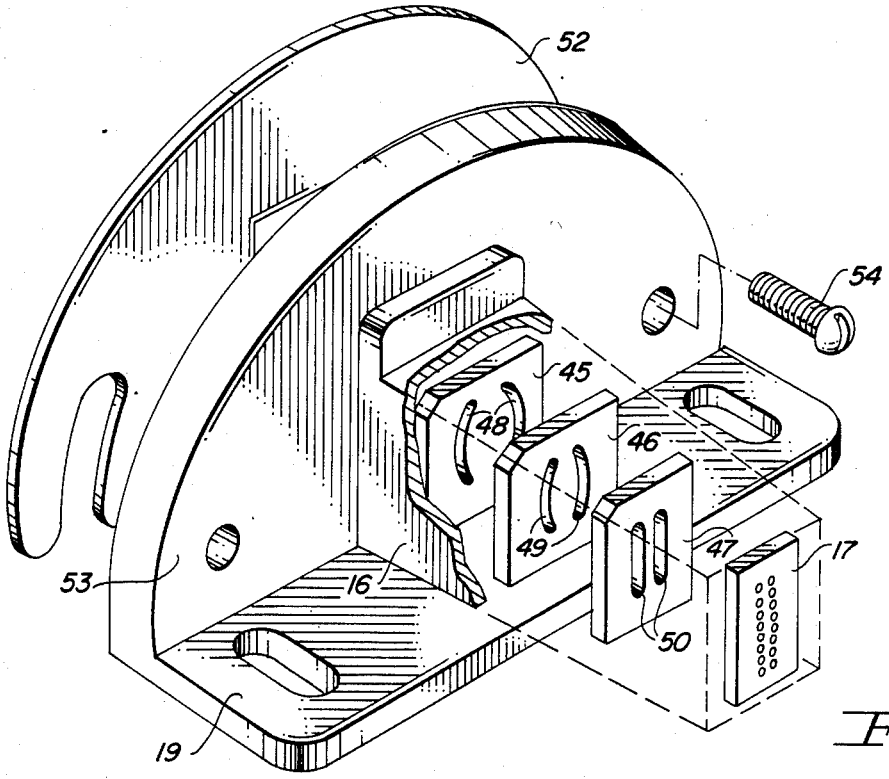
FIG. 6 is a three-quarter perspective view of the nose portion of the print head with portions broken away to show the wire guides therein; and, FIG. 7 is a fragmentary perspective view showing an armature employed in the print head and magnetic members associated therewith.

In accordance with this invention, the nose portion 16 of the head 11 is equipped with a series of plate-like guides, each of which are adapted to guide a plurality of print wires with the result that the guides are less difficult and less expensive to fabricate. The preferred guide structures are illustrated most clearly in FIGS. 2 and 6. There is provided a series of guide plates designated 45, 46 and 47 for progressively guiding the print wires 14 to retain their natural curvature from their driven ends 22 in elliptic array to their printing ends in a double row array provided by nose guide 17. Guide 45 is provided with two arcuate guide slots 48 approximating the elliptic array of the driven ends 22 of the wires 14. Each of the slots 48 is adapted to guide one half of the total number of wires passing through the print head nose portion 16. Formation of the two arcuate slots 48 in guide 45, either by machining or by injection molding, is a much simpler process than attempting to provide an individual guide hole for each of the print wires 14 passing through the guide. Similarly, guide plate 46 has a pair of arcuate slots 49 therein. Slots 49 have less curvature than slots 48 in plate 45 because the print wires 14 are more nearly approaching the dual line array configuration at their printing ends. Guide plate 47, which just precedes nose plate 17, preferably also has two slots 50 therein, which nearly approximate the row array configuration of nose guide 17. Each of the guide plates 45, 46 and 47 can be readily fabricated or molded from plastic material. These guide plates are positioned by and affixed to a plurality of flanges 51 provided on the interior of nose portion 16.

It is desirable to provide in the print head 11 some means for effecting adjustment of the position of the printing ends of the print wires 14 in relation to the nose guide 17 of the head to compensate for wear of the printing ends of the print wires with use. That feature is available with the print head constructed in accordance with this invention and is provided by incorporating a resilient, or otherwise yieldable, spacer gasket 52 between a flange portion 53 of nose portion 16 and the face of cover 39. By manipulating threaded fasteners, such as screws 54, connecting nose portion 16 to cover 39, it is possible to adjust the position of the nose portion 16 in relation to the other components of the print head. By tightening screws 54, the spacer gasket 52 is compressed and as a result, the nose portion 16 and its nose guide 17 are moved in a direction to tend to expose the printing ends of the print wires 14. Wear of the printing ends of wires 14 resulting in shortening of these wires can be compensated for simply by tightening screws 54 and compressing gasket 52 to the desired extent. The gasket 52 can be made from resilient material, such as rubber or plastic, or from a yieldable substance such as a soft metal.

Incorporation of the gasket 52 between print head nose portion 16 and cover 39 also facilitates precision manufacture of the print head 11. The gasket 52 can be omitted during a preliminary assembly of the nose portion 16 to cover 39 of the print head. With minute portions of the printing ends of the wires 14 protruding from nose guide 17, these ends can be finely machined and polished to assure that they are absolutely flat and in alignment with each other. Thereafter, the nose portion 16 can be loosened from the cover 39, the yieldable gasket 52 placed between the two and then the screws 54 tightened to bring the nose portion 16 and the cover 39 into proper relationship to ensure that the printing ends of the wires 14 do not protrude from the nose guide 17 when the wires are in their non-print, or cocked, position. This assures that the non-printing wires will not engage and drag on the ink ribbon 15 during operation of the print head.

Figure 7:
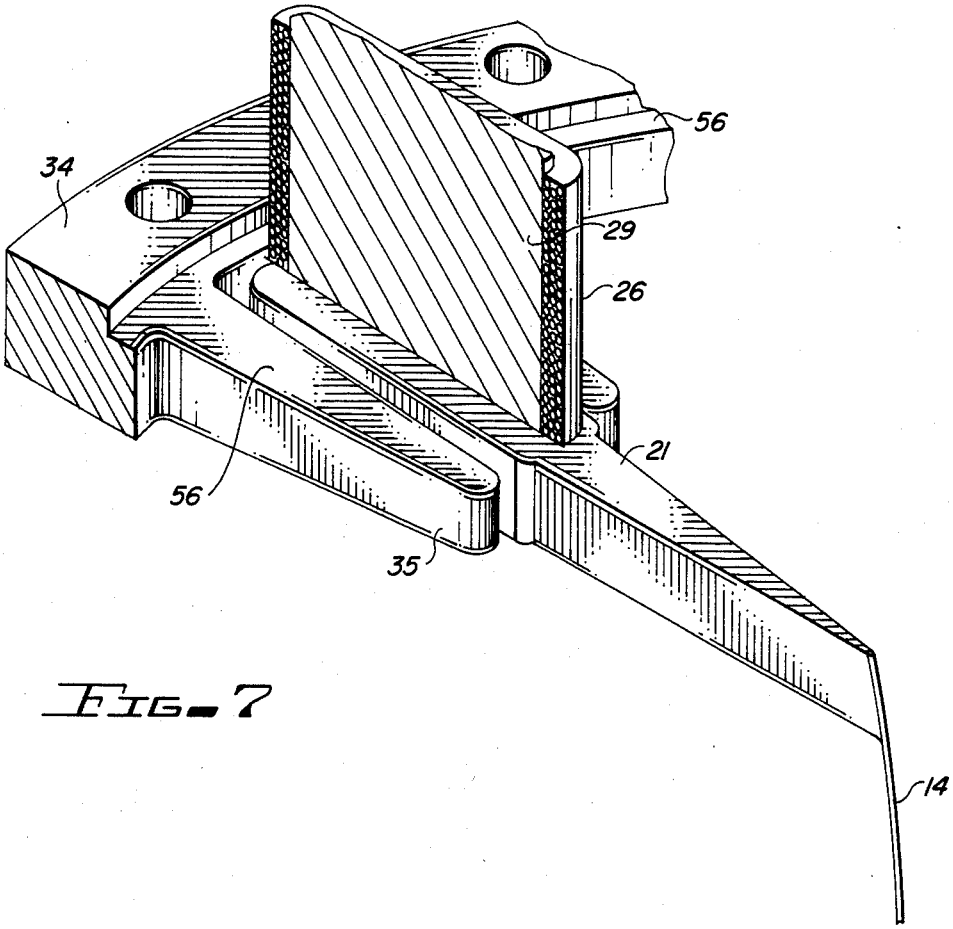

FIG. 7 illustrates another feature of the invention by which the performance characteristics of the print head 11 may be further improved. As there shown, the inner edge of yoke plate 34 and yoke fingers 35 protruding inwardly therefrom can be machined, or cut away, as indicated at 56 so that the thickness of the fingers 35 and the inner edge of the yoke plate 34 are of less height than the height of the armature 21 adjacent thereto and spaced from the end of the core 29 for the electromagnet 26 associated with the armature. This arrangement assures that the magnetic flux from yoke plate 34 and fingers 35 thereon will flow through the armature 21 to the electromagnetic core 29 and not bypass the armature by flowing directly from the fingers to the electromagnet core 29. Thus, maximum utilization of the magnetic flux is made for the purposes of moving or controlling the movement of armatures 21.

From the foregoing, it should be apparent that this invention provides an improved dot matrix print head having various characteristics and features not present in prior art print heads.

What is claimed is:

1. A print head for a dot matrix printer comprising a plurality of print wires each having a printing end and a driven end, said wires having their printing ends disposed in an elongated array in a plane substantially normal to the length of the wires adjacent their printing ends, a guide member for guiding movement of the printing ends of said wires, a plurality of armatures equal in number to the number of wires, each of said armatures having a movable end portion connected to the driven end of one of said wires, the moveable end portions of said armatures being disposed in an elliptic array the major axis of which is generally parallel to the direction of elongation of the array in which the printing ends of the wires are disposed, electromagnetic means for effecting movement of said armatures, spring means connected to the end of each armature opposite the end which is connected to a print wire for moveably supporting the armature, and an annular fulcrum ring in contact with said spring means, said ring having a serrated inner edge providing a generally straight segment normal to each of said armatures, said ring edge segments being disposed in an elliptic array so that the distance between each segment and the moveable end of the armature with which it is associated is the same for all of the armatures.

2. The print head of claim 1 further comprising a nose member housing said guide member, a cover for said armatures, and means for adjustably mounting said nose member on said cover comprising a yieldable spacer between the nose member and the cover and a threaded fastener connecting said nose member and said cover.

* * * * *